US006781509B1

(12) United States Patent
Oppedahl et al.

(10) Patent No.: US 6,781,509 B1
(45) Date of Patent: Aug. 24, 2004

(54) ALARM REPORTING SYSTEM

(75) Inventors: Carl Oppedahl, Kenai Peninsula Parish, AK (US); Thomas C Bennett, Summit County, CO (US)

(73) Assignee: Oppedahl & Larson LLP, Dillon, CO (US)

( * ) Notice: Subject to any disclaimer, the term of this patent is extended or adjusted under 35 U.S.C. 154(b) by 0 days.

(21) Appl. No.: 09/712,651

(22) Filed: Nov. 13, 2000

Related U.S. Application Data

(60) Provisional application No. 60/165,213, filed on Nov. 12, 1999.

(51) Int. Cl.[7] ..... G08B 9/00

(52) U.S. Cl. ..... 340/286.01; 340/3.1; 340/5.3; 340/5.33; 340/506; 340/517

(58) Field of Search ..... 340/286.01, 628, 340/577, 531, 541, 506, 517, 5.3, 5.33, 5.21, 5.51, 7.5, 3.1; 705/35, 39, 41, 42; 709/224

(56) References Cited

U.S. PATENT DOCUMENTS 4,962,377 A * 10/1990 Wallace et al. ..... 340/825.4
5,886,634 A * 3/1999 Muhme ..... 340/572.1
5,914,675 A * 6/1999 Tognazzini ..... 340/989
6,038,549 A * 3/2000 Davis et al. ..... 705/35
6,060,994 A * 5/2000 Chen ..... 340/825.06
6,121,885 A * 9/2000 Masone et al. ..... 340/628
6,160,477 A * 12/2000 Sandelman et al. ..... 340/506
6,163,257 A * 12/2000 Tracy ..... 340/506
6,182,497 B1 * 2/2001 Krajci ..... 73/23.2
6,215,404 B1 * 4/2001 Morales ..... 340/577

OTHER PUBLICATIONS

Programming Worksheets; DSC™ Power 832™ Security System; PC5010, Version 1.0, pp. 4–23.
Installation Manual; DSC™ Power 832™ Security System; PC5010, Version 1.0, pp. 1–46.

* cited by examiner

*Primary Examiner*—Davetta W. Goins
(74) *Attorney, Agent, or Firm*—Oppedahl & Larson LLP

(57) ABSTRACT

A method and apparatus reports alarm events detected by an alarm system having a plurality of users, each user having a name and identified by an identifier other than the name. The system detects an event of interest relating to a user, creates a data stream indicative of the event and indicative of the identifier of the user, extracts from the data stream the identifier of the user, determines the name of the user based upon the identifier of the user, selects a message recipient based upon the event of interest, creates a text message addressed to the selected message recipient, the text message communicating the name of the user and communicating information indicative of the event of interest, and transmits the text message via a global communications network.

8 Claims, 1 Drawing Sheet

ALARM REPORTING SYSTEM

This application claims priority from Provisional Patent Application No. 60/165,213 filed on Nov. 12, 1999.

BACKGROUND

Alarm systems such as burglar alarm systems and fire alarm systems aren't very helpful if they don't pass their messages quickly to the intended parties. Many alarm systems only pass messages to central monitoring companies and the messages are often coded rather than easily human-readable. With most such systems, only drastic events such as fire or burglary are ever communicated to users, and then only through the central monitoring company. Most other events, such as arming and disarming the alarm system, are ignored by the system or are merely logged by the central monitoring company and otherwise not made available in any general and real-time way to users such as principals of a premises being monitored. It is generally uneconomic to expect that the central monitoring company would consistently report all events of interest to users, rather than reporting only drastic events.

It is desirable to provide an improved system in which alarm events of interest are communicated to users even when they are routine events which a central monitoring company would not wish to spend time communicating to users. It is desirable to provide such a capability in existing alarm systems. It is desirable to provide messages in such a system which are human-readable and which indicate in human-readable form information about the users associated with particular events such as arming or disarming the system.

SUMMARY OF THE INVENTION

A method and apparatus reports alarm events detected by an alarm system having a plurality of users, each user having a name and identified by an identifier other than the name. The system detects an event of interest relating to a user, creates a data stream indicative of the event and indicative of the identifier of the user, extracts from the data stream the identifier of the user, determines the name of the user based upon the identifier of the user, selects a message recipient based upon the event of interest, creates a text message addressed to the selected message recipient, the text message communicating the name of the user and communicating information indicative of the event of interest, and transmits the text message via a global communications network.

DESCRIPTION OF THE DRAWING

The invention will be described with respect to a drawing, of which.

DETAILED DESCRIPTION

Figure 1:
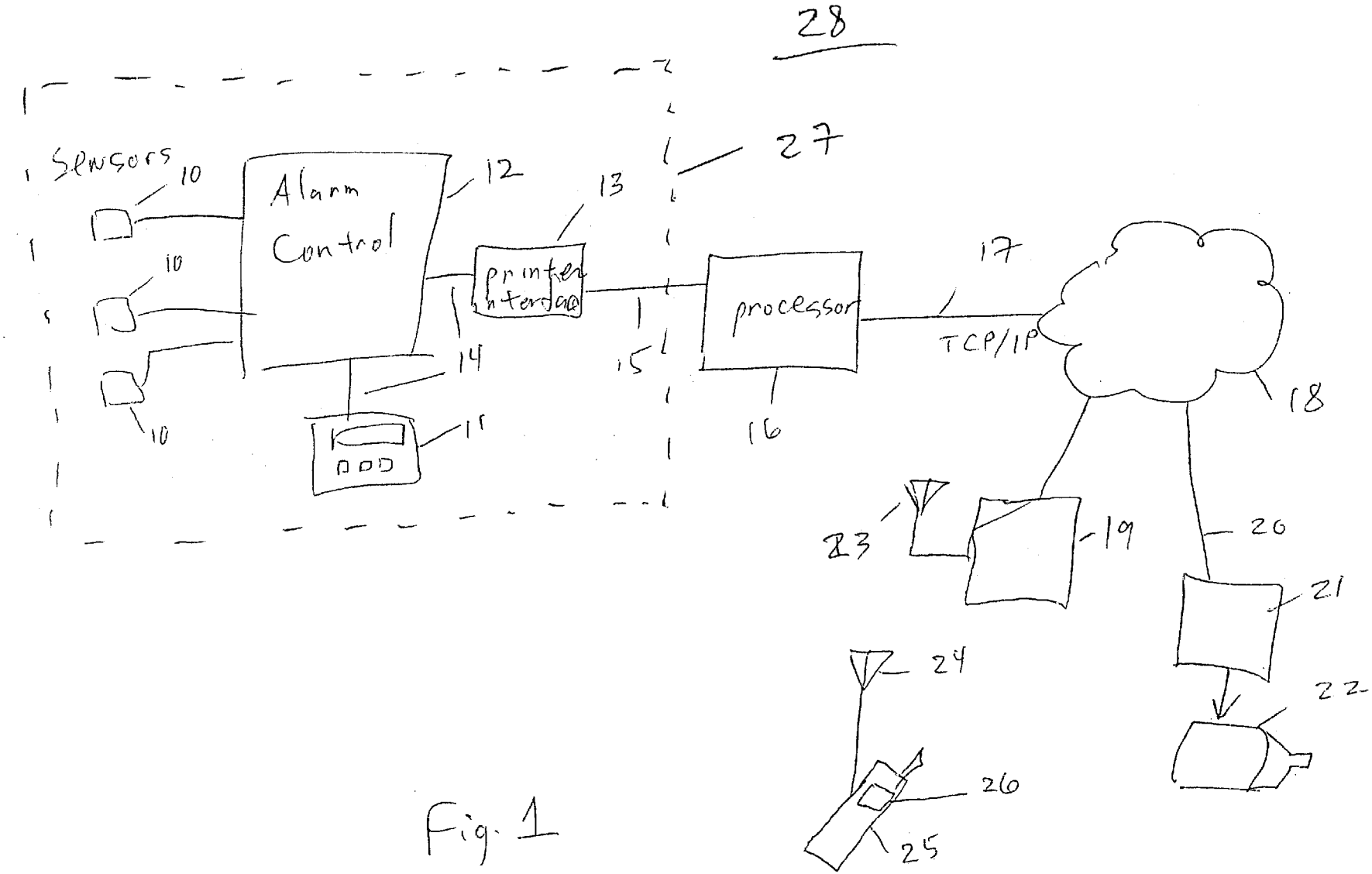
FIG. 1 is a functional block diagram of a system according to the invention.
Figure 1:
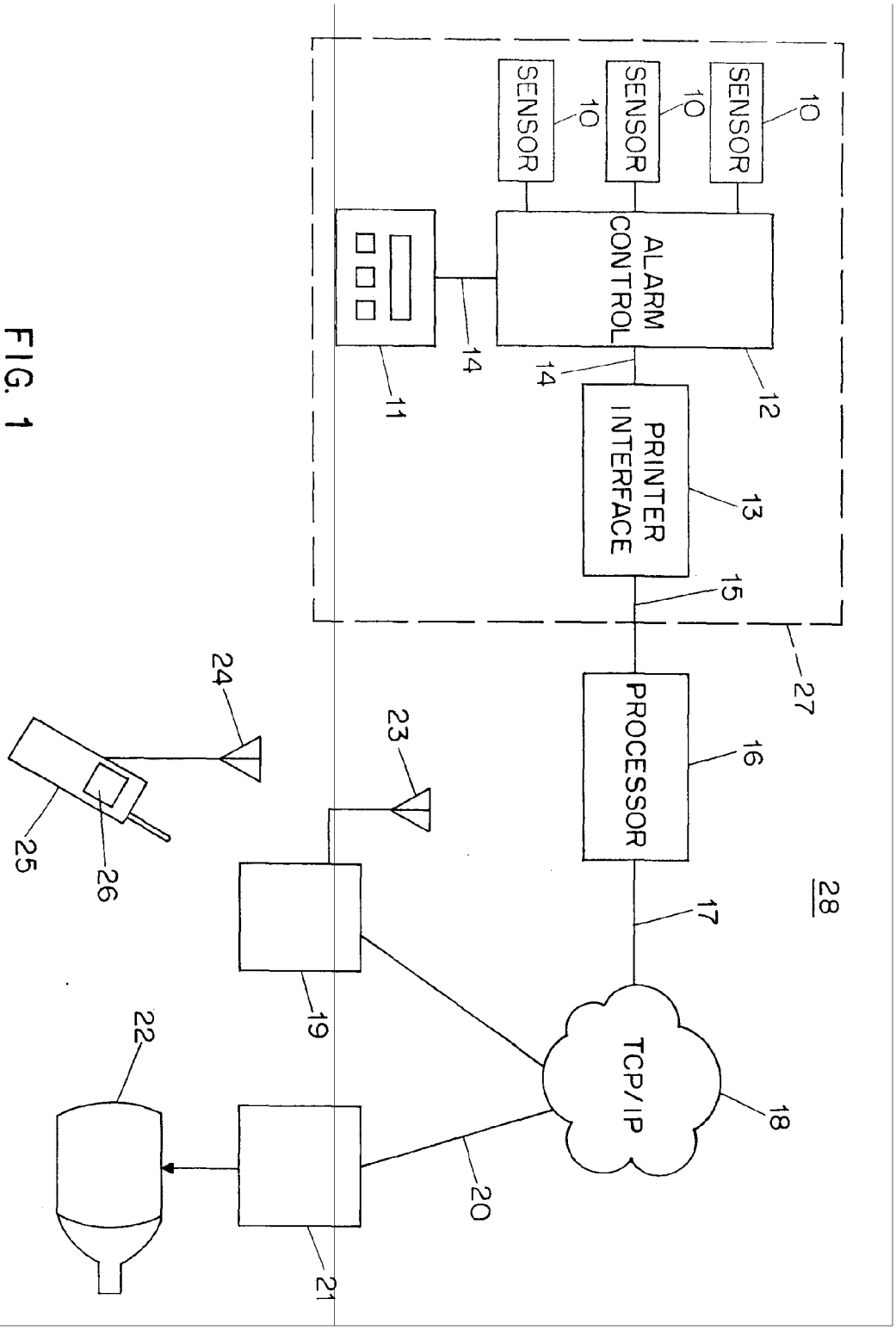

In the system 28 according to the invention, an alarm control unit 12 is connected to sensors 10 to monitor a premises against buglary or fire or other hazards. A user can arm and disarm the alarm control unit from a keypad 11 connected with the control unit 12 via communications link 14, typically a four-wire serial data bus.

Control unit 12 is preferably a Digital Security Controls Model 832 control unit. The keypad 11 preferably has an LCD display.

Connected to the control unit 12 is a printer interface 13, designed to provide an RS232 serial data stream to an ASCII printer not shown in FIG. 1. The design of the control unit 12 is such that many events of interest cause the control unit 12 to send ASCII characters over serial line 13. Events communicated in this way include disarming ad arming the system (indicating by number which user performed the arm or disarm), as well as alarm events. When an alarm event occurs the control unit sends ASCII characters to indicate which sensor 10 was triggered.

A processor 16 is provided which has a serial port connecting with the printer interface 13 by an RS232 serial link. The processor 16 executes software described in more detail below. Preferably the printer interface 13 monitors the RS-232 handshake signal called Data Terminal Ready ("DTR"), annunciating loss of that signal to the user at the keypads 11 and printing information about the rise and fall of DTR at the printer output line 15 at such time as the DTR signal is restored to its asserted state.

Note that depending on the make and model of alarm system, functional blocks 12 and 13 may be integrally formed or may be physically separate.

Processor 16 receives the serial data stream and interprets the user number, if present, according to a lookup table to replace the user number with the associated name.

Additionally, it is desirable to have a lookup table listing the would-be recipients of email and for each, the rule determining which events they would be told of via email.

The unit 16 selects a user, assembles an SMTP message, and passes the message through the Internet cloud 17 via a TCP/IP line 17.

In the case where a text message is to be sent to a cell phone, the scenario is as follows. The message is passed to the cell phone infrastructure 19. The message is passed along, and is eventually transmitted over the air on aerial transmission.

In the case where a text message is to be sent to a wired computer 21, the scenario is carried out by means of the message being passed through the public switched data network as in FIG. 1. The message is displayed on a cathode-ray-tube display 22 or on some other suitable display such as a liquid-crystal display.

It is desirable to determine the MX record associated with the email domain name. Then when the time comes to send email, one can skip the task of doing a DNS lookup. Instead, one can simply send messages using the IP address of the destination SMTP server. This reduces the dependence on one's own SMTP server and on the risk that a crashed email or DNS server on one's own premises will cause problems.

Those skilled in the art will appreciate that the function of blocks 13 and 16 could be performed by separate equipment, as shown in FIG. 1, or could be performed by a single piece of equipment suitably programmed.

What is claimed is:

1. A method for reporting alarm events detected by an alarm system associated with a plurality of users, each user having a name and identified by an identifier other than the name, and each user being capable of arming and/or disarming the alarm, the method performed with respect to a processor, the method comprising the steps of:

said alarm system detecting an event of interest relating to a user, including, arming or disarming the alarm;

said alarm system creating a data stream indicative of the event and indicative of the identifier of the user who armed or disarmed the alarm;

said processor receiving the data stream;

said processor extracting from the data stream the identifier of the user who armed or disarmed the alarm;

said processor determining the name of the user based upon the identifier of the user who armed or disarmed the alarm;

said processor selecting a message recipient based upon the event of interest;

said processor creating a text message addressed to the selected message recipient, said text message communicating the name of the user who armed or disarmed the alarm and communicating information indicative of the event of interest;

said processor transmitting the text message via a global communications network.

2. The method of claim 1 wherein the global communications network is the Internet.

3. The method of claim 1 wherein the data stream is a serial data stream.

4. The method of claim 1 wherein the event of interest comprises a user arming the alarm system.

5. The method of claim 1 wherein the event of interest comprises a user disarming the alarm system.

6. A system for reporting alarm events detected by an alarm system having a plurality of users, each user having a name and identified by an identifier other than the name, the system comprising:

an alarm control unit connected with a plurality of sensors and with a keypad;

a data table containing names of said users, each of said users being capable of arming or disarming the alarm, and the data table associating said names with corresponding identifiers;

a rule table containing rules defining events of interest and for each event, a corresponding message delivery address;

first means responsive to the sensors and to the keypad for detecting events of interest, including, arming and disarming of the alarm;

second means responsive to detection of an event of interest, including, arming and disarming of the alarm, and an identifier for determining, from the data table, the name associated with the identifier;

third means responsive to the detected event of interest for determining, from the rule table, the corresponding message delivery address;

fourth means responsive to the corresponding message delivery address and the name for transmitting a message communicating the event of interest and the name, said message directed to the message delivery address.

7. The system of claim 6 wherein the second, third, and fourth means all comprise a personal computer executing a predetermined computer program, and wherein the first means comprises the alarm control unit.

8. The system of claim 6 wherein the first, second, third, and fourth means comprise the alarm control unit.

* * * * *

UNITED STATES PATENT AND TRADEMARK OFFICE

CERTIFICATE OF CORRECTION

PATENT NO. : 6,781,509 B1
DATED : August 24, 2004
INVENTOR(S) : Carl Oppedahl et al.

It is certified that error appears in the above-identified patent and that said Letters Patent is hereby corrected as shown below:

Delete drawing sheet containing the figure, and substitute therefore the drawing sheet consisting of the figure as shown on the attached sheet.

Column 2,
Line 4, “ad” should be corrected to -- and --.

Signed and Sealed this

Sixth Day of September, 2005

JON W. DUDAS
*Director of the United States Patent and Trademark Office*